United States Patent [19]

Douglas-Hamilton

[11] Patent Number: 4,530,816

[45] Date of Patent: Jul. 23, 1985

[54] METHOD AND DEVICE FOR COOLING, PRESERVING AND SAFELY TRANSPORTING BIOLOGICAL MATERIAL

[75] Inventor: Diarmaid H. Douglas-Hamilton, Beverly, Mass.

[73] Assignee: Hamilton Farm, South Hamilton, Mass.

[21] Appl. No.: 504,578

[22] Filed: Jun. 15, 1983

[51] Int. Cl.[3] ..... F25D 3/08

[52] U.S. Cl. ..... 422/1; 62/64; 62/372; 62/457; 62/463

[58] Field of Search ..... 62/64, 371, 372, 457, 62/463; 422/1, 40

[56] References Cited

U.S. PATENT DOCUMENTS

| | | | |
|---|---|---|---|
| 2,315,425 | 3/1943 | Hill et al. | 62/1 |
| 3,238,002 | 3/1966 | O'Connell et al. | 312/213 |
| 3,309,893 | 3/1967 | Heffler et al. | 220/902 |
| 3,654,773 | 4/1972 | White | 62/371 |
| 3,810,367 | 5/1974 | Peterson | 62/457 |
| 3,940,943 | 3/1976 | Sikes et al. | 62/64 |
| 4,145,895 | 3/1979 | Hjertstrand | 62/457 |
| 4,292,817 | 10/1981 | Loucks | 62/530 |
| 4,311,022 | 1/1982 | Hall | 62/457 |
| 4,322,954 | 4/1982 | Sheehan et al. | 62/371 |

*Primary Examiner*—Ivars Cintins
*Attorney, Agent, or Firm*—Lahive & Cockfield

[57] ABSTRACT

A container for cooling, preserving and safely transporting a biological specimen includes a thermally insulating over-all container having as contents a container for ice, a container for the specimen including an isothermal metal cup, and a thermally insulating sheet interposed between the specimen container and the ice, the over-all container and the insulating sheet having thermal constants chosen to control the cooling rate, preferably to approximately one to three minutes per degree Centigrade, and to achieve a steady state temperature of the specimen near, but above freezing, preferably in the range of 4° C. to 10° C.

The method of the invention includes the steps of packing biological specimens just after they are obtained into a specimen container and placing the specimen container near ice in an over-all insulating container, with a thermally insulating sheet between the ice and the specimen container, the thermal constants being chosen to cool down the specimen at an optimum cooling rate and to achieve an optimum steady state temperature for the specimen.

20 Claims, 2 Drawing Figures

METHOD AND DEVICE FOR COOLING, PRESERVING AND SAFELY TRANSPORTING BIOLOGICAL MATERIAL

BACKGROUND

This invention relates generally to a method and device for cooling, preserving and safely transporting biological material such as equine semen specimens and equine embryos and particularly to such methods and devices that provide an optimum cooling rate and optimum steady state temperature for the cooled specimen.

Artificial insemination for improving livestock has long been a feature of animal husbandry. More recently, the suitability of some animal semen, such as that of bulls, for preservation by freezing has meant that specimens of such semen could be put into condition for preservation for relativey long periods of time, and be put into condition for easy transportation. As a result, it is relatively easy to provide such specimens for use at locations distant in time or place from the location where the specimen was originally obtained.

Equine artificial insemination has proven to be not so convenient. Equine semen appears to be much more sensitive to changes in temperature, to freezing, and to physical shock in transportation. In the case of equine semen, freezing the semen specimen for storage or transport results in a greatly decreased potency following thaw. Freezing appears to result in internal damage to the spermatozoa. In practice, typical post-thaw fertility is only 50–60%, whereas cooled but unfrozen semen has experimentally demonstrated a fertility rate of near 90% after 24 hours.

Furthermore, the post-warmup potency of equine semen depends strongly on the rate that it was cooled to achieve even the short term preservation of efficacy. Too rapid a temperature decrease results in thermal shock to the spermatozoa. Too slow a temperature change leaves the spermatozoa at high temperature for too long, causing decreased viability.

Many of the devices and methods used for preserving and transporting other kinds of biological material are therefore imappropriate for equine semen. The devices and methods often allow physical shock to the material, extremely low temperatures unsuitable for equine semen, uncontrolled rates of cooling, and time consuming procedures that do not take into account the relatively short time that equine semen remains viable after being obtained, even if cooled properly.

Therefore, ordinarily, mares are brought to a stud farm at great expense and inconvenience, rather than have equine semen specimens transported for any distance, because of the high rate of failure when such transportation has been attempted. Equine artificial insemination has therefore been, up until now. restricted in its use.

It is therefore an object of this invention to provide methods and devices for reliably preserving and safely transporting free from physical shock equine semen so that specimens may be preserved for commercially reasonable times (e.g. twenty-four hours) and be transportable in commercially reasonable means (e.g. trucks and planes).

It is also an object to provide a method and device for promptly cooling equine semen at an optimum controlled rate, and combining the cooling with transporting the specimen, so its eventual use elsewhere is shortened significantly. It is a further object to provide for achieving a steady state temperature for the cooled down specimen that is an optimum temperature for preservation of its efficacy.

It is a further object of the invention to provide such methods and devices that do not require chemicals for refrigation that must be controlled carefully to avoid contamination and harm, but rather may use the latent heat absorption in the phase change of common ice, even though an equine semen specimen should not be reduced in temperature to 0° C.

It is a further object of the invention to provide a method for protection against physical shock, which is important for preservation of semen potency during its transportation.

Finally, it is an object of the invention to provide methods and devices for preserving and transporting equine semen that are inexpensive to manufacture from commonly available components and that are easy to use.

The invention is also useful for the cooling, preservation and storage of equine embryos, which require handling similar to equine semen, and, indeed, for other similar biological materials.

SUMMARY OF THE INVENTION

The device of the invention, for cooling, preserving and safely transporting biological specimens, comprises means for containing the specimen, which is introduced to the containing means at body temperature shortly after it is obtained. The device also contains means for cooling the containing means, including a refrigerant at a temperature below the optimum temperature for preserving the viability of the specimen. Preferably the refrigerant is ice, commonly available and chemically inoffensive. The device further includes thermally insulating barrier means interposed between the containing means and the cooling means, for controlling the rate of cooling of the specimen, and thermally insulating support means for supporting the specimen containing means and thermally insulating it from the ambient temperature.

The thermally insulating barrier means and the thermally insulating support means define thermal constants. The constants are selected so that the rate of cooling of the specimen is an optimum rate. Preferably the rate is between one and four minutes per degree Centigrade. Experiments have shown that an initial cooling rate in that range gives the highest forward progressive motility (the best observable indicator of fertility) following warmup. The constants are selected also to provide the optimum steady state temperature for the specimen following the cool down period. The optimum steady state temperature is near, but above, 0° C., and a temperature in the range of 4° C. to 10° C. appears to give the best results.

In preferred embodiments the specimen containing means includes a walled container having thermally conductive wall portions, which may be a metal cup, and the thermally insulating barrier means comprises a sheet of material between the cup and the refrigerant, whose thickness may be varied to vary the rate of cooling of the specimen. The thermally insulating support means may be a vacuum bottle (Dewar flask) or a foamed plastic walled container.

Also, the ice is preferably gelatinized, that is, mixed with gelatine, and is contained in a metal container. The specimen containing means includes thermal ballast means adjacent the specimen for providing a predetermined thermal inertia for the specimen containing means, that may be selected so that the rate of cooling of the specimen is an optimum one.

The method of the invention, for cooling, preserving and safely transporting a biological specimen, comprises the steps of providing an over-all insulating container, providing in the over-all container a refrigerant, such as ice, at a temperature below the optimum temperature for preserving the viability of the specimen, providing in the over-all container a specimen container for receiving a specimen at body temperature, providing in the over-all container a thermally insulating barrier between the refrigerant and the specimen container to control the rate of cooling of the specimen in the specimen container by the refrigerant, and selecting the over-all insulating container and the thermally insulating barrier so that they define thermal constants providing an optimum cooling rate for the specimen and an optimum steady state temperature for the specimen.

BRIEF DESCRIPTION OF THE DRAWINGS

Other objects, features and advantages of the invention will be apparent from, or will be set forth in, the following description of preferred embodiments of the invention, including the drawing thereof, in which.

DESCRIPTION OF THE PREFERRED EMBODIMENTS

Figure 1:
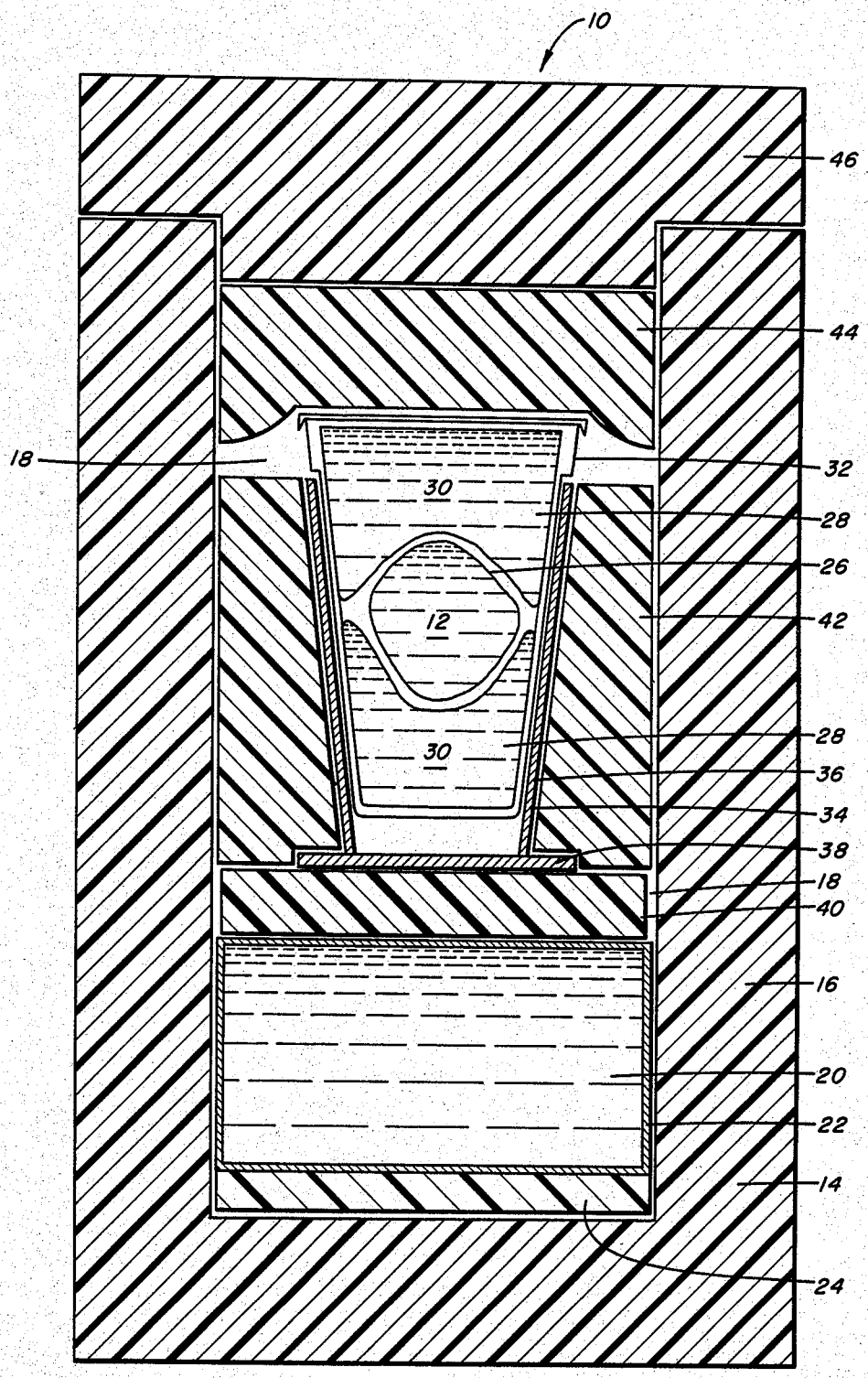
FIG. 1 is a sectional elevational view of a device according to the invention.

As shown in FIG. 1, a container 10 for cooling, preserving and transporting equine semen specimens 12 includes an over-all thermally insulating support structure such as a cylindrical foamed plastic container 14. The container 14 has thermally insulating walls 16 defining an interior storage space 18.

At the bottom of the interior storage space 18 is a coolant, or refrigerant 20, preferably contained in a container such as a metal can 22 conforming in shape to the bottom of the storage space 18, for convenience of handling. Preferably, the refrigerant 20 is ice or gelatinized ice, since ice combines large latent heat with a chemically inoffensive nature. Other refrigerants besides ice may be used, however. A layer of foam 24 may be placed below the ice refrigerant can 22 to provide upward pressure to the refrigerant 20 to maximize heat transfer and to add shock absorbing capability.

The equine semen specimen 12 is contained in the embodiment shown in a specimen container 26 which is a plastic bag that allows the specimen container 26 to conform to the shape of its surroundings for maximizing heat transfer. The specimen container 26 is arranged between plastic thermal ballast bags 28 containing material 30 of high thermal inertia, such as water, in a specimen jar 32. The specimen container 26, alternatively, could be a glass or plastic rigid container since the ballast bags 28 are flexible plastic and could be manipulated around it. The ballast bags 28 not only provide thermal inertia to the specimen container 26, but also provide shock absorption means to the specimen 12.

The specimen jar 32 is supported inside an isothermal cup 34 which it fits closely. The isothermal cup 34 is a cup with walls 36, including a bottom 38, of metal such as copper or aluminum. The isothermal cup 34 facilitates heat transport around the specimen jar 32, removing heat from the jar's contents at a rate uniform over the surface of the jar 32. By way of example, the isothermal cup 34 may be constructed of copper sheet 1/32 inch thick.

A thermally insulating barrier 40 is interposed between the isothermal cup 34 and the refrigerant 20 below. The barrier 40 preferably consists of a disk of plastic material, such as, for example, nylon, polystyrene, polyethylene or the like, of diameter somewhat smaller than the diameter of the storage space 18. For example, by way of illustration, the barrier 40 may be a polyethylene disk 4 inches in diameter and ¼ inch thick. The barrier 40, for convenience, may be glued to the underside of the isothermal cup 34.

Finally, plastic foam side walls 42 are glued to the side of the isothermal cup 34 in order to provide shock resistance, and an insulating flexible plastic foam top 44 is used as a plug at the top of the storage space 18. A lid 46 secures the contents of the container 10.

In a typical container 10, the specimen jar 32 is 200 ml and two ballast bags 28 contain 80 and 60 ml of aqueous thermal ballast 30. The volume of the specimen 12 is typically 20 to 50 ml. It is evident that the useful lifetime of the container arrangement is that required for the ice 20 to melt, and that the lifetime can be increased as required by using more ice. In practice it is found that adequate lifetime is provided by only 300 grams of ice.

Figure 2:
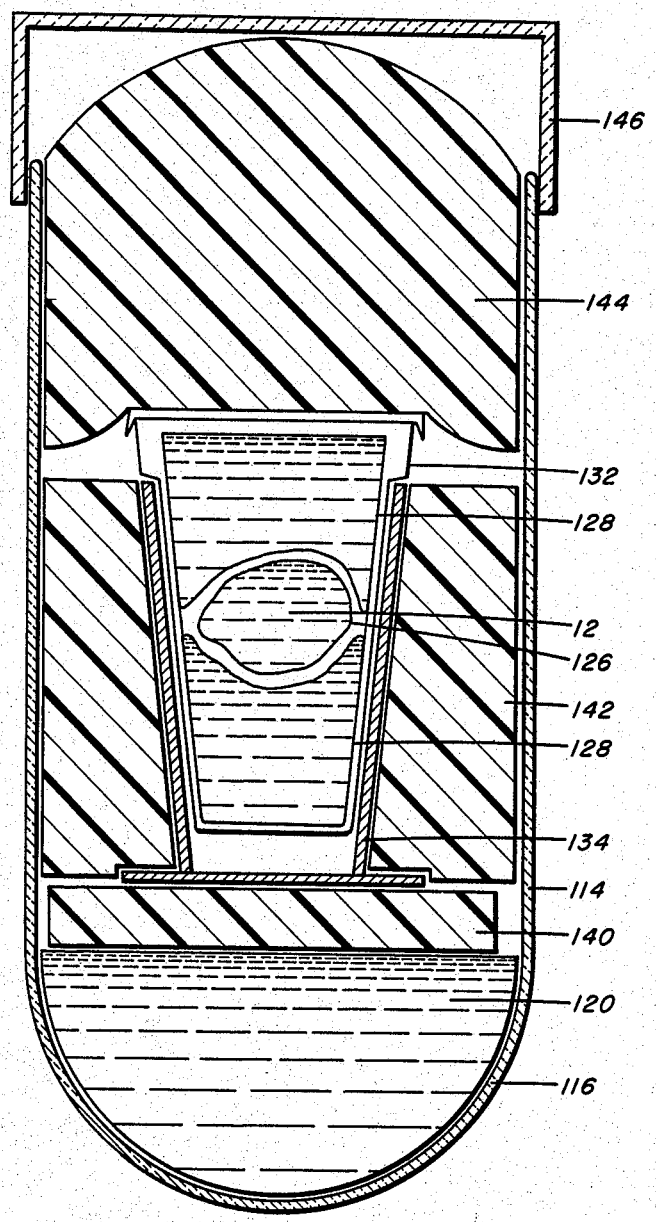
FIG. 2 is a view like that of FIG. 1 of another embodiment of the invention.

FIG. 2 shows an alternative embodiment of the invention in which the over-all container is not a foamed plastic container 14 but is instead a vacuum bottle 114, with thermally insulating walls 116 and a lid 146. The foam plastic container 14 has greater shock resistance than does the vacuum bottle 114, though the vacuum bottle 114 has greater thermally insulating qualities.

The contents of the interior of the vacuum bottle 114, namely, the refrigerant 120 (which may be in a metal container), the specimen container 126, thermal ballast bags 128, specimen jar 132, isothermal cup 134, thermally insulating barrier 140, and plastic foam side walls 142 and top 144 surrounding the cup 134, all are substantially the same as those described in the first embodiment, and function and interact in the same manner.

The use of the container 10 begins immediately after collection of a specimen 12 from an animal. After specimen collection, the semen specimen is extended (life-extending material added) in the conventional manner. Following extension, the specimen 12, which is near the body temperature of a horse (near 37° C.) is put into the specimen container 26 and is surrounded by the ballast bags 28, also at 37° C. The specimen container 26 and ballast bags 28 are placed in the specimen jar 32, placed in turn in the isothermal cup 34. The container 10 is loaded with a suitably shaped metal can 22 containing gelatinized ice 20, and the cup 34 is placed atop it, with the thermally insulating barrier 40 interposed between the cup 34 and ice 20. The specimen 12 starts to cool as soon as the cup 34 is loaded into the container 10, at a decrease rate of about three minutes per degree Centigrade (at least initially). The temperature decreases to about 5° C. and can remain there for over 30 hours under normal conditions, enough to make the method and the device commercially feasible.

The temperature, T, of the specimen 12 as a function of time is given approximately by the expression:

$$T=A-(A-T_{10})e^{-Bt}$$

where $T_{10}$ is the initial specimen temperature (typically about 37° C.) and A and B are thermal constants depending on the external ambient temperature To, the mass of the loaded isothermal cup 34, M, and (referring to the first embodiment) the dimensions and thermal conductivity of the foamed plastic container 114, the plastic foam top 144, the lid 146, and the thermally insulating barrier 140, given by the expressions:

$$A=T_o/[1+R^2k'/[wk(r_1^2/L_3+2L_1/1n(r_2/r_1))]]$$

and $$B=\pi[r_1^2k/L_3+2L_1k/1n(r_2/r_1)+R^2k'/w]/MC$$

where R is the isothermal cup 34 base radius, $r_1$ is the container 114 inner radius, $r_2$ is the container wall outer radius, w is the thermally insulating barrier 140 thickness, k is the mean thermal conductivity of the insulating walls, k' is the thermal conductivity of the thermally insulating barrier 140, $L_1$ is the height of the isothermal cup 34, $L_3$ is the height of the insulating foam plastic top 144, and C is the specific heat of the isothermal cup and contents. In the reduction to practice of the invention the measured cooling rate and the final temperature reached were very close to those predicted by the above expressions. The formula will give the specimen temperature variation with time as long as the refrigerant remains at a constant temperature (assuming unchanged external temperature). In the case of a phase-change coolant, or refrigerant, such as ice, the coolant or refrigerant temperature will remain sensibly at 0° C. until all the ice has melted. In the case of gelatinized ice, the thermal impedance between the refrigerant and the specimen gradually increases as the melting ice leaves a layer of immobile gelatine between itself and the specimen, thereby reducing the rate of cooling, whereas normal ice melts into liquid water, the convective action of which provides much greater thermal transfer (which may be excessive). The time taken for all the ice to melt is the solution of the implicit equation:

$$e^{-Bt}=C_1-C_2t,$$

where $C_1$ and $C_2$ are constants depending on the same parameters as A and B, and also on the latent heat L and mass m of the refrigerant. They are given by the expressions:

$$C_1=1+LmwB/[\pi R^2k'(A-T_{10})]$$

and $$C_2=B[A+kwT_o(2L_2/1n(r_2/r_1)+r_1^2/L_4)/(R^2k')[-/]A-T_{10}]$$

where $L_2$ is the height of the refrigerant chamber and $L_4$ is the thickness of the container insulating base.

After the initial cooling down of the specimen 12, the temperature of the specimen 12 will eventually reach a steady state temperature slightly above that of the refrigerant 20, a temperature determined primarily by the balance between heat flow through the walls 16 of the vacuum bottle 14 from the external environment to the specimen, and heat flow out of the specimen through the insulating barrier 40 into the refrigerant 20.

The rate of cooling and the steady state temperature may be varied by varying the thermal inertia of the specimen jar 32 by adding thermal ballast 30 to the relatively small mass of the specimen 12 itself, thereby reducing the rate of cooling, or by selecting vacuum bottles 14 (or foam plastic boxes 114) and varying the thickness of the insulating barrier 40 to vary the thermal constants, as is well known to those skilled in the art.

Modifications of the embodiments described above, which are only illustrative other than those already suggested, may be made by those skilled in the art without however departing from the spirit and scope of the invention, as set forth in the following claims.

What is claimed is:

1. A device for cooling, preserving and safely transporting a specimen selected from the group consisting of equine semen and equine embryos, comprising:

means containing a specimen selected from the group consisting of equine semen and equine embryos, means for cooling said containing means, comprising refrigerant at a temperature below the optimum temperature for preserving the viability of said specimen, thermally insulating barrier means substantially completely interposed between said containing means and said cooling means for controlling a continuous rate of cooling of said specimen by said cooling means, said thermally insulating barrier means defining thermal constants selected so that said rate of cooling of said specimen is an optimum cooling rate, and thermally insulating support means for supporting said specimen containing means and thermally insulating said specimen containing means from ambient temperature.

2. The device of claim 1 wherein said thermally insulating barrier means and said thermally insulating support means define thermal constants selected so that said rate of cooling of said specimen is an optimum cooling rate.

3. The device of claim 2 wherein said cooling rate is approximately one to three minutes per degree Centigrade.

4. The device of claim 1 wherein said specimen containing means includes a walled container having thermally conductive wall portions.

5. The device of claim 1 wherein said specimen containing means includes a metal cup.

6. The device of claim 5 wherein said thermally insulating barrier means comprises a sheet of material between said cup and said refrigerant, whose thickness may be varied to vary the rate of cooling of said specimen.

7. The device of claim 1 wherein said refrigerant comprises ice.

8. The device of claim 1 wherein said refrigerant comprises gelatinized ice.

9. The device of claim 1 wherein said thermally insulating support means comprises a vacuum bottle.

10. The device of claim 1 wherein said thermally insulating support means comprises a foamed plastic walled container.

11. The device of claim 1 wherein said thermally insulating barrier means and said thermally insulating support means define thermal constants selected so that said specimen is maintained, after cooling, at an optimum temperature.

12. The device of claim 11 wherein said temperature is in the range of approximately 4° C. to 10° C.

13. The device of claim 1 wherein said specimen containing means includes thermal ballast means adjacent said specimen for providing a predetermined thermal inertia for said specimen containing means.

14. The device of claim 13 wherein said thermal ballast means is selected so that said rate of cooling of said specimen is an optimum cooling rate.

15. The device of claim 1 wherein said means for cooling said containing means comprises a metal containing means for containing said refrigerant.

16. A device for cooling, preserving and transporting a specimen selected from the group consisting of equine semen and equine embryos, comprising:

means containing a specimen selected from the group consisting of equine semen and equine embryos, including a substantially isothermal wall, means for cooling said specimen containing means, including means for containing ice, thermally insulating barrier means substantially completely interposed between said specimen containing means and said cooling means, for controlling a continuous rate of cooling of said specimen by said cooling means, and a thermally insulating support container for containing, and thermally insulating from ambient temperature, said specimen containing means, said cooling means and said thermally insulating barrier means, said thermally insulating barrier means and said thermally insulating support container defining thermal constants selected so that said cooling rate is approximately one to three minutes per degree Centigrade and so that said specimen is maintained, after cooling, at a temperature in the range of approximately 4° C. to 10° C.

17. A method for cooling, preserving and transporting a specimen selected from the group consisting of equine semen and equine embryos, comprising:

providing an over-all insulating container, providing in said over-all container a refrigerant at a temperature below the optimum temperature for preserving the viability of said specimen, providing in said over-all container a specimen container for receiving a specimen at body temperature, providing a thermally insulating barrier between said refrigerant and said specimen container to control a continuous rate of cooling of said specimen in said specimen container by said refrigerant, and selecting the over-all insulating container and the thermally insulating barrier so that they define thermal constants providing an optimum cooling rate for said specimen and an optimum steady state temperature for said specimen.

18. The method of claim 17 where said refrigerant is ice.

19. The method of claim 17 where said cooling rate is approximately one to three minutes per degree Centrigrade.

20. The method of claim 17 where said optimum steady state temperature is in the range of approximately 4° C. to 10° C.

* * * * *

UNITED STATES PATENT AND TRADEMARK OFFICE

CERTIFICATE OF CORRECTION

PATENT NO. : 4,530,816

DATED : July 23, 1985

INVENTOR(S) : Diarmaid H. Douglas-Hamilton

It is certified that error appears in the above-identified patent and that said Letters Patent is hereby corrected as shown below:

In the formula shown in Column 5, lines 52-53, after "($R^2k'$), change "[/]A-$T_{10}$]" to --]/[A-$T_{10}$]--.

Signed and Sealed this

Tenth Day of December 1985

[SEAL]

Attest:

DONALD J. QUIGG

Attesting Officer

Commissioner of Patents and Trademarks